US007015861B2

(12) United States Patent
Boyd et al.

(10) Patent No.: US 7,015,861 B2
(45) Date of Patent: Mar. 21, 2006

(54) COATING APPLIED ANTENNA AND METHOD OF MAKING SAME

(75) Inventors: Robert C. Boyd, Richmond, VA (US); Wayne B. Legrande, Chesapeake, VA (US)

(73) Assignee: Unitech, LLC, Wake Forest, NC (US)

( * ) Notice: Subject to any disclaimer, the term of this patent is extended or adjusted under 35 U.S.C. 154(b) by 0 days.

(21) Appl. No.: 10/487,867

(22) PCT Filed: Oct. 25, 2002

(86) PCT No.: PCT/US02/34132

§ 371 (c)(1),
(2), (4) Date: Feb. 26, 2004

(87) PCT Pub. No.: WO03/038948

PCT Pub. Date: May 8, 2003

(65) Prior Publication Data

US 2004/0196192 A1 Oct. 7, 2004

Related U.S. Application Data

(60) Provisional application No. 60/330,653, filed on Oct. 26, 2001.

(51) Int. Cl.
*H01Q 1/38* (2006.01)

(52) U.S. Cl. ..... 343/700 MS; 343/830; 343/873; 428/327

(58) Field of Classification Search ..... 343/700 MS, 343/705, 829, 830, 872, 873; 428/327
See application file for complete search history.

(56) References Cited

U.S. PATENT DOCUMENTS

| | | | | |
|---|---|---|---|---|
| 3,816,837 | A | 6/1974 | Smith | 343/713 |
| 4,388,388 | A | 6/1983 | Kornbau et al. | 430/258 |
| 4,546,357 | A | 10/1985 | Laughon et al. | 343/702 |
| 4,812,853 | A | 3/1989 | Negev | 343/700 MS |
| 5,008,681 | A | 4/1991 | Cavallaro et al. | 343/700 MS |
| 5,155,493 | A | 10/1992 | Thursby et al. | 343/700 MS |
| 5,355,142 | A | 10/1994 | Marshall et al. | 343/700 MS |
| 5,665,274 | A | 9/1997 | Long et al. | 252/511 |
| 5,914,283 | A * | 6/1999 | Yamada et al. | 442/117 |
| 5,991,136 | A | 11/1999 | Kaczmarek et al. | 361/93.8 |
| 6,111,552 | A | 8/2000 | Gasser | 343/875 |
| 6,137,444 | A | 10/2000 | Pettersson et al. | 345/700 MS |
| 6,229,488 | B1 | 5/2001 | Lin et al. | 343/700 MS |
| 6,492,950 | B1 | 12/2002 | Nakano et al. | 343/700 MS |
| 6,576,336 | B1 * | 6/2003 | LeGrande | 428/327 |

* cited by examiner

*Primary Examiner*—Shih-Chao Chen
(74) *Attorney, Agent, or Firm*—Jacobson Holman PLLC

(57) ABSTRACT

An antenna (100) applied to a structure (200), the antenna (100) comprising a series of conductive and dielectric coatings. A conductive coating backplane or ground plane (110) is applied to a substrate structure (200), a non-conductive dielectric coating (120) is applied over the outer surface of the conductive coating backplane or ground plane (202), and a conductive coating patch, microstrip array or radiating element (130) is applied over the outer surface of the dielectric coating (**120*b*). The pin of a coaxial cable (304) extends through the conductive coating backplane (110), the dielectric coating (120), and the conductive coating patch (130), for transmission of a signal from the antenna (100**). The method allows for the non-destructive application of antennas on existing platforms for receiving and transmitting electromagnetic signals.

29 Claims, 9 Drawing Sheets

COATING APPLIED ANTENNA AND METHOD OF MAKING SAME

This application claims priority to provisional U.S. Application Ser. No. 60/330,653 filed Oct. 26, 2001.

This is a nationalization of PCT/US02/34132 filed Oct. 25, 2002 and published in English.

FIELD OF THE INVENTION

The present invention relates to coating-applied antennas and the method of making the same. More specifically, the invention relates to a coating-applied antenna that employs a conductive coating in place of the metal parts of a conventional antenna and a dielectric coating for the dielectric layer of a conventional antenna.

BACKGROUND OF THE INVENTION

The military has a need for low profile, low cost, low maintenance antennas that can be flush mounted on various types of land, air, and water platforms, including but not limited to tanks, aircraft, ships, and even articles of clothing. Low profile phased arrays are currently offered by the aircraft industry. Low profile mechanical scanned antennas, which provide wider scan coverage at a much lower cost, are also available. Phased arrays and mechanical antennas are each suited to the requirements of different platforms. Both of these are considered surface mounted low profile antennas.

Although using the aircraft structure as an actual part of the radiating antenna is very attractive, most of the time it is impractical. Combining antenna installation and platform manufacture may simplify the fabrication process and reduce cost; however, the materials and shape of the aircraft may not be compatible with antenna design requirements.

Microstrip patch antennas have also been proposed. Examples of microstrip antennas are U.S. Pat. No. 4,812,853 (Negev), U.S. Pat. No. 5,008,681 (Cavallaro et al.), and U.S. Pat. No. 5,355,142 (Marshall et al.). However, a microstrip patch antenna is less efficient at VHF/UHF. Also, microstrip antennas are inherently narrowband (only a few percent), making them unsuitable for most VHF/UHF communication applications. In general, to be an efficient radiator an antenna must be resonant. Thus its size must be close to one-half the operating wavelength. At VHF/UHF this can be several meters to several tenths of a meter. Because of limited real estate on platforms such as aircraft, microstrip patch antennas are seldom used below 1 GHz.

In summary, patch antennas for frequencies below 1 GHz have very limited application in airborne systems. For those applications that do exist, antennas made using existing technology can be flush mounted on existing aircraft platform. Integrating them into the aircraft structure (so that they are part of the airborne platform) is technically very difficult, and does not offer any better performance or cost benefits.

In the microwave and EHF bands, microstrip antennas offer great benefits. They are thin, light weight, and low profile, and their 5 to 10% bandwidth is sufficient for most COM and RADAR applications. Bandwidth can be further increased by adding another dielectric layer with a passive patch on top of it. Furthermore individual patches can be networked into a group of radiating elements resulting in well-known, phased-array antennas. Phased arrays of microstrip patches offers superior performance, such as high gain, electronic steering, independent multiple beams, frequency agility, adaptive pattern control, digital beamforming, etc. Although patches appear simple in design, they require specific substrate materials in precise physical structures that typically consist of multi-layer boards. However, conventional, flat panel PC board technology cannot be applied on sharply or double curved aircraft surfaces such as aircraft wings, aircraft body, etc.

It is to the solution of these and other objects to which the present invention is directed.

BRIEF SUMMARY OF THE INVENTION

It is therefore a primary object of the present invention to provide a coating-applied-type antenna that can be applied not only on flat surfaces, but also on sharply or double curved platforms such as aircraft wings, aircraft body, and other aircraft surfaces, sonar domes, other ship surfaces, and all other types of transportation vehicles. The coating-applied-antenna can also be applied to stationary surfaces such as buildings, etc.

It is another object of the invention to provide an antenna that can be applied to a substrate without causing structural or other physical damage to the substrate.

These and other objects of the invention are achieved by the provision of an antenna applied to a structure, the antenna comprising a series of conductive and dielectric coatings; and of a method of applying an antenna to a structure by using a series of conductive and dielectric coatings. The method allows for the non-destructive application of antennas on existing platforms for receiving and transmitting electromagnetic signals. The antenna can be applied to surfaces such as aluminum, steel, metal alloys, composite structures, fiber reinforced plastics, polycarbonate, acrylic, polyethylene, polypropylene, fiberglass, existing coating systems, textiles, and paper.

In one aspect of the invention, an antenna comprises a conductive coating backplane or ground plane (depending upon whether the antenna is a GPS or other microstrip antenna) applied to a substrate structure such as a curved aircraft surface, a non-conductive dielectric coating applied over the outer surface of the conductive coating backplane or ground plane, and a conductive coating patch or microstrip array or radiating element (again depending upon whether the antenna is a GPS or other microstrip antenna) applied over the outer surface of the dielectric coating. The center conductor of a coaxial cable or the pin of a coaxial connector extends through and is insulated from the conductive coating backplane or ground plane and the dielectric coating, and is in contact with the conductive coating patch or microstrip array or radiating element, for transmission of a signal from the antenna.

The conductive coating backplane or ground plane, and the conductive coating patch or microstrip array or radiating element, are formed of an electrically conductive and electromagnetic radiation absorptive coating composition such as the UNISHIELD® conductive coating composition disclosed in U.S. application Ser. No. 09/151,445, filed Sep. 11, 1998, which is incorporated herein by reference in its entirety (hereafter, "the original UNISHIELD® conductive coating composition"). The original UNISHIELD® conductive coating composition disclosed in U.S. application Ser. No. 09/151,445 comprises an emulsion polymer binder, which is a blend of a first emulsion containing a conjugated diene monomer or comonomer, and a second emulsion containing an acrylic polymer. It also contains an effective amount of electrically conductive particles dispersed in the binder, and water as a carrier. The electrically conductive particles include a combination of graphite particles and metal-containing particles, the graphite particles preferably being natural flake graphite and the metal-containing particles preferably being silver or nickel containing particles.

The conductive coating backplane or ground plane and the conductive coating patch or microstrip array or radiating element can also be formed of a composition that is an improvement of the original UNISHIELD® conductive coating composition (hereafter, "the improved UNISHIELD® conductive coating composition"), which is also the invention of the present inventors, Robert C. Boyd and Wayne B. LeGrande. In the improved UNISHIELD® conductive coating composition, the second emulsion of the polymer binder can be selected from any of an acrylic, aliphatic or aromatic polyurethane, polyester urethane, polyester, epoxy, polyamide, polyimide, vinyl, modified acrylic, fluoropolymer, and silicone polymer, or a combination thereof. Also, in the improved UNISHIELD® conductive coating composition, the electrically conductive particles can be selected from any of graphite particles, carbon nanotubes, and metal containing particles, or a combination thereof. The graphite particles are preferably natural flake graphite. The carbon nanotubes are preferably 10 to 60 nanometers in diameter and from less than 1 micron to 40 microns in length. The metal containing particles are preferably silver or nickel containing particles; however, other metals may also be employed such as gold, platinum, copper, aluminum, iron or iron compounds and palladium. The metal containing particles are more preferably metal coated ceramic microspheres or metal coated ceramic fibers; however, other metal coated particles may also be employed such as metal coated glass flake, glass spheres, glass fibers, boron nitride powder or flake and mica flakes.

The dielectric coating is a high build material that comprises one or more of the following polymers: acrylic emulsion; styrene modified acrylic emulsion; acrylic modified epoxy dispersion; polyurethane dispersion; and dimethylpolysiloxane dispersion. The dielectric coating also contains one or more of the following pigments: magnesium silicate; aluminum silicate; alkali aluminio silicate; calcium carbonate; fumed silica; and ground glass.

The film thickness for the applied conductive coating will vary based on the antenna type. For example, the conductive coating backplane and the conductive coating patch for a GPS patch type antenna are about 3–10 mils in thickness each. The high build dielectric coating is about 20–150 mils in thickness. For a VHF or UHF system the conductive coating film thickness would be about 3–10 mils.

The conductive coating backplane or ground plane, dielectric coating, and conductive coating patch or microstrip array or radiating element can also be formed as self-adhesive sheets or films tailored to specific dimensions necessary for a specific frequency range.

In still another aspect of the invention, the antenna includes a protective film applied over the conductive coating patch or microstrip array or radiating element, the dielectric coating, and the conductive coating backplane or ground plane.

In still another aspect of the invention, where the substrate is a conductive metal, the substrate itself can form the conductive backplane or ground plane, with the dielectric coating being applied to the outer surface of the platform and the conductive coating patch or microstrip array or radiating element being applied to the outer surface of the dielectric coating. Where the substrate is a dielectric composite resin, the substrate itself can form the dielectric layer, with the conductive coating backplane or ground plane being applied to the inner surface of the platform and the conducting coating patch being applied over the outer surface of the platform.

In accordance with the invention, the method as carried out for a GPS patch type antenna comprises attaching the coaxial cable or coaxial connector to the substrate, with the center conductor or pin extending therethrough and being insulated around its base, applying the conductive coating back plane to the substrate structure, applying the non-conductive dielectric coating over the outer surface of the conductive coating back plane, and applying the conductive coating patch over the outer surface of the dielectric coating so that the center conductor or pin extends through and is insulated from the conductive coating back plane and the dielectric coating and is in contact with the conductive coating patch. A coaxial cable can also be connected directly to the antenna by connecting the coaxial cable shield to the conductive coating back plane with the cable insulator and the center conductor extending through the conductive coating back plane with the center conductor connected to the conductive coating patch. The connection of the coaxial pin and coaxial shield can be made with the conductive coating itself; therefore, no soldering or adhesives are necessary for the electrical connection.

Other objects, features and advantages of the present invention will be apparent to those skilled in the art upon a reading of this specification including the accompanying drawings.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which.

DETAILED DESCRIPTION OF THE INVENTION

Figure 1:
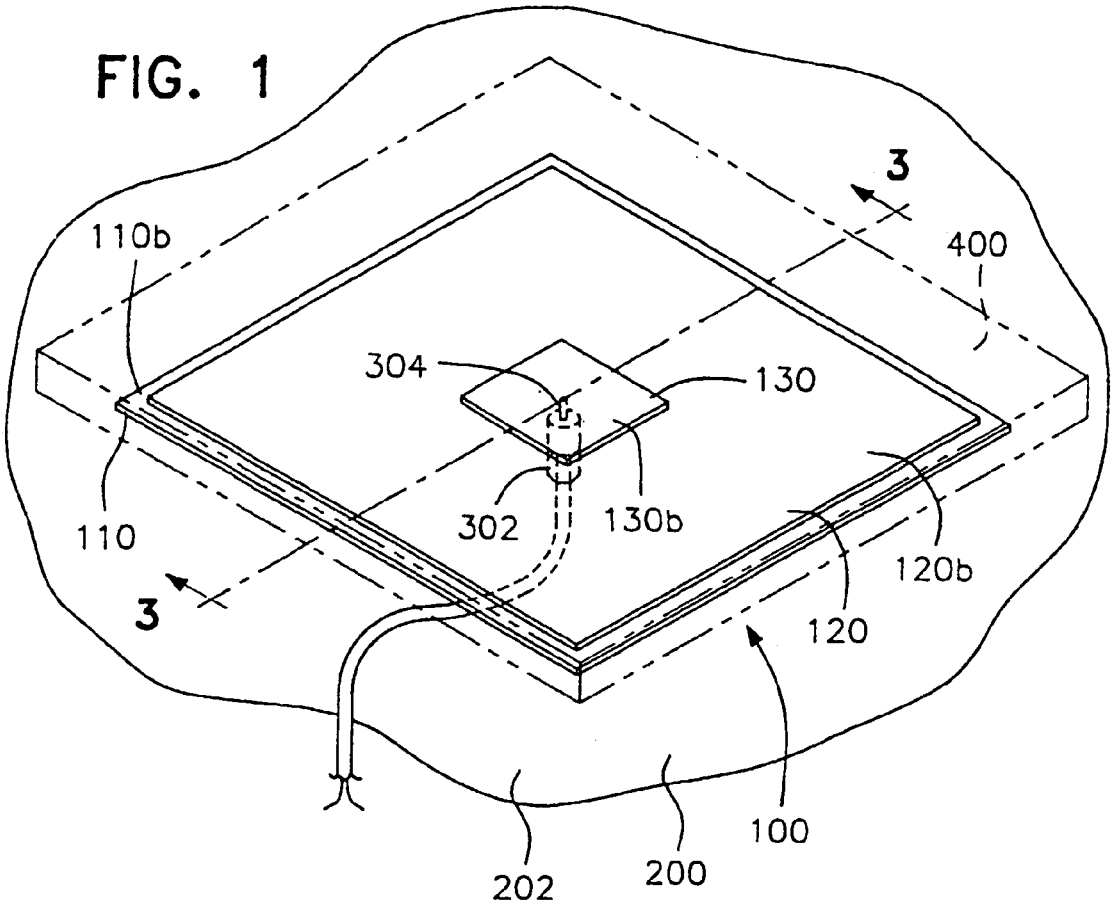
FIG. 1 is a top perspective view of a first embodiment of an antenna in accordance with the present invention, applied to a substrate surface.

In describing preferred embodiments of the present invention illustrated in the drawings, specific terminology is employed for the sake of clarity. However, the invention is not intended to be limited to the specific terminology so selected, and it is to be understood that each specific element includes all technical equivalents that operate in a similar manner to accomplish a similar purpose.

Figure 2:
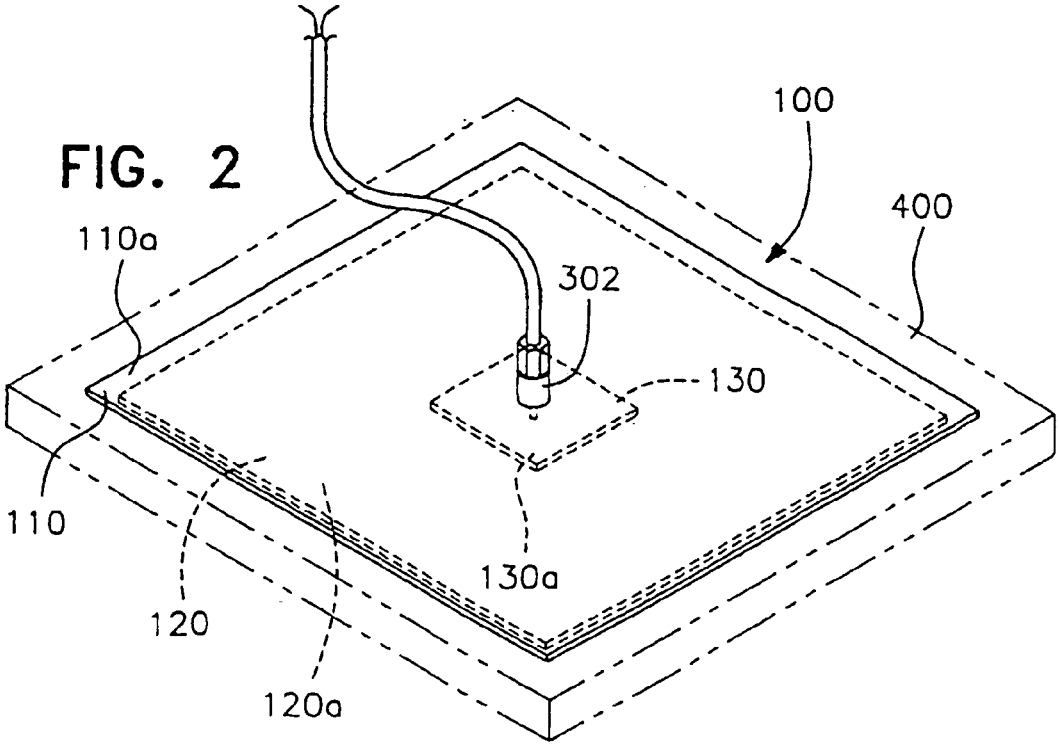
FIG. 2 is a bottom perspective view of the antenna of FIG. 1.
Figure 3:
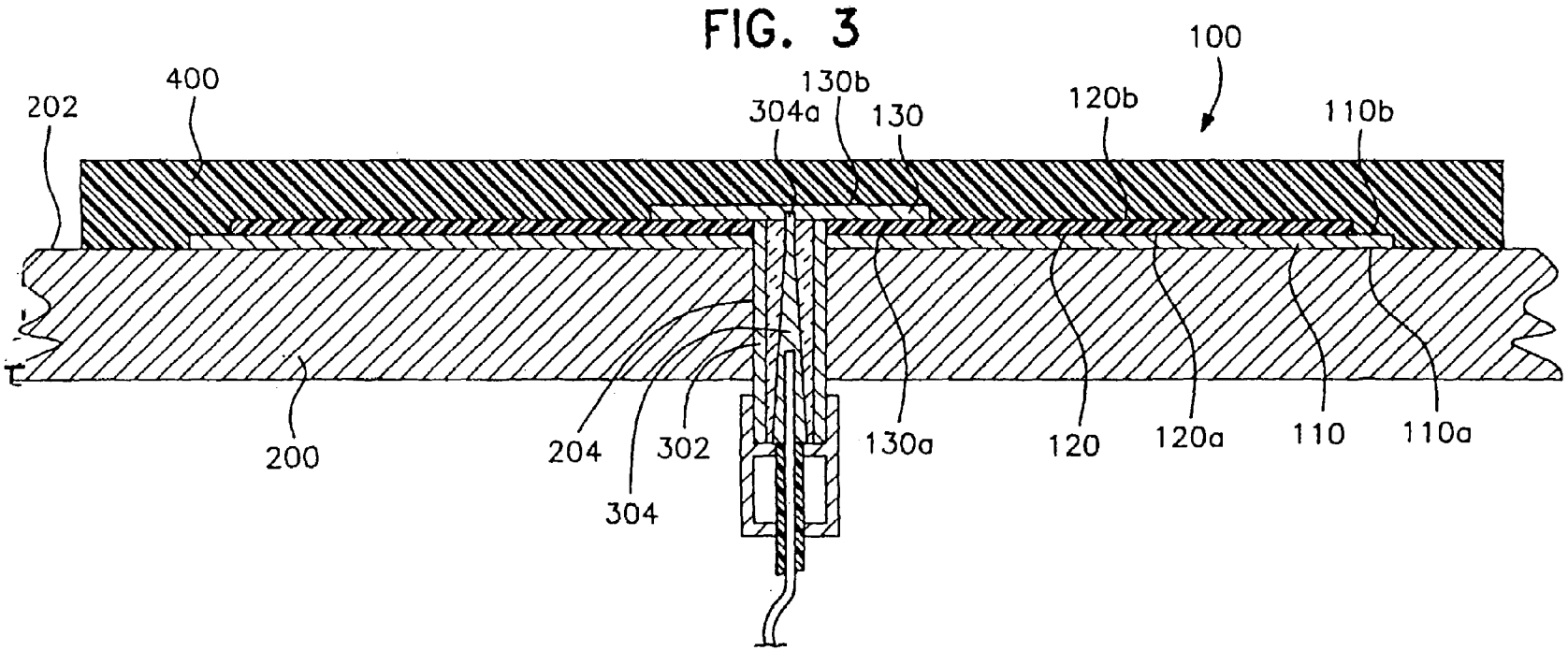
FIG. 3 is a cross-sectional view taken along line 3—3 of FIG. 1.
Figure 4:
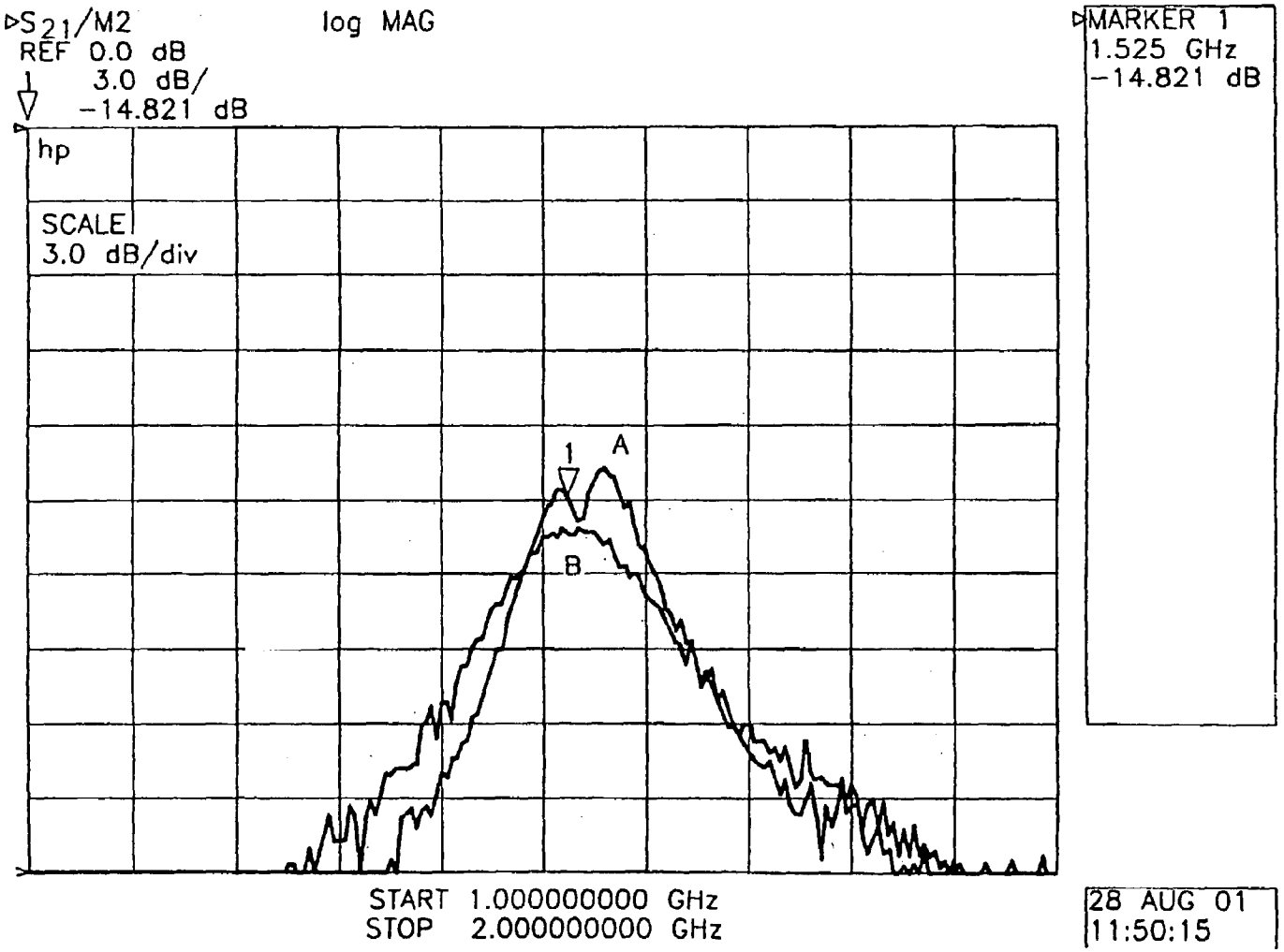
FIGS. 4–10 are graphs demonstrating the improvements in gain achieved by the addition of a tuning stub, frequency (measured in GHz) being plotted against gain (measured in dB).
Figure 5:
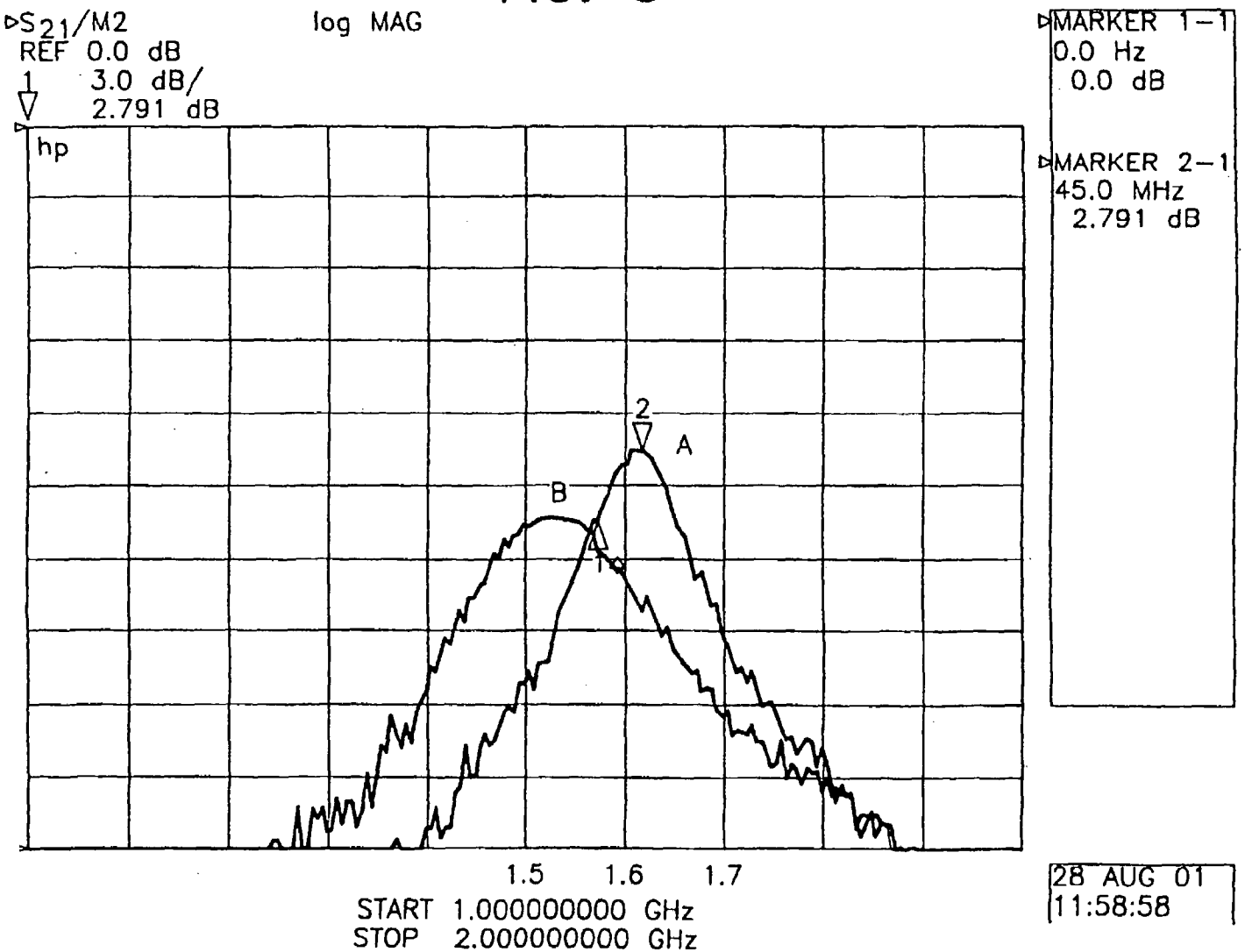

Referring now to FIGS. 1–3, there is shown an antenna 100 in accordance with the present invention applied to an outer surface of a substrate structure 200 such as a curved aircraft surface, particularly a sharply or double curved surface such as an aircraft wing, body, etc, as well as on internal communication systems platforms such as ships, aircraft, building structures, etc. The substrate structure 200 can be made of materials such as aluminum, steel, metal alloys, composite structures, fiber reinforced plastics, polycarbonate, acrylic, polyethylene, polypropylene, fiberglass, existing coating systems, textiles, and paper.

The antenna 100 comprises a conductive coating backplane or ground plane 110 (depending upon whether the antenna is a GPS or other microstrip antenna) applied to the outer surface 202 of the substrate structure 200. The conductive coating backplane or ground plane 110 has an inner surface 110*a* facing towards the outer surface 202 of the substrate structure 200 and an outer surface 110*b* facing away from the outer surface 202 of the substrate structure 200. A non-conductive dielectric coating 120 is applied over the outer surface 110*b* of the conductive coating backplane or ground plane 110. The dielectric coating 120 has an inner surface 120*a* facing towards the outer surface 110*b* of the conductive coating backplane or ground plane 110, and an outer surface 120*b* facing away from the outer surface 110*b* of the conductive coating backplane or ground plane 110. A conductive coating patch or microstrip array or radiating element 130 (again depending upon whether the antenna is a GPS or other microstrip antenna) is applied over the outer surface 120*b* of the dielectric coating 120. The conductive coating patch or microstrip array or radiating element 130 has an inner surface 130*a* facing towards the outer surface 120*b* of the dielectric coating 120, and an outer surface 130*b* facing away from the outer surface 120*b* of the dielectric coating 120.

The end 302 of a conventional coaxial connector or coaxial cable 300 is inserted through an aperture 204 (see FIG. 3) in the substrate structure 200, prior to application of the conductive coating backplane or ground plane 110, the dielectric coating 120, and the conductive coating patch or microstrip array or radiating element 130 to the substrate structure 200. The center conductor or pin 304 of the coaxial connector or cable 300 is insulated along its length, except at its tip 304*a*, which is uninsulated and in contact with the conductive coating patch or microstrip array or radiating element 130, for transmission of a signal from the antenna 100.

The conductive coating backplane or ground plane 110 and the conductive coating patch or microstrip array or radiating element 130 are formed of an electrically conductive and electromagnetic radiation absorptive coating composition such as the original UNISHIELD® conductive coating composition disclosed in U.S. application Ser. No. 09/151,445, filed Sep. 11, 1998. The original UNISHIELD® conductive coating composition comprises an emulsion polymer binder, which is a blend of a first emulsion containing a conjugated diene monomer or comonomer, and a second emulsion containing an acrylic polymer. It also contains an effective amount of electrically conductive particles dispersed in the binder, and water as a carrier. The electrically conductive particles include a combination of graphite particles and metal-containing particles, the graphite particles preferably being natural flake graphite and the metal-containing particles preferably being silver or nickel containing particles.

The conductive coating backplane or ground plane 110 and the conductive coating patch or microstrip array or radiating element 130 can also be formed of the improved UNISHIELD® conductive coating composition, which as mentioned above is the invention of Robert C. Boyd and Wayne B. LeGrande. In the improved UNISHIELD® conductive coating composition, the second emulsion of the polymer binder can be selected from any of an acrylic, aliphatic or aromatic polyurethane, polyester urethane, polyester, epoxy, polyamide, polyimide, vinyl, modified acrylic, fluoropolymer, and silicone polymer, or a combination thereof. Also, in the improved UNISHIELD® conductive coating composition, the electrically conductive particles can be selected from any of graphite particles, carbon nanotubes, and metal containing particles, or a combination thereof. The graphite particles are preferably natural flake graphite. The carbon nanotubes are preferably 10 to 60 nanometers in diameter and from less than 1 micron to 40 microns in length. The metal containing particles are preferably silver or nickel containing particles; however, other metals may also be employed such as gold, platinum, copper, aluminum, iron or iron compounds and palladium. The metal containing particles are more preferably metal coated ceramic microspheres or metal coated ceramic fibers; however, other metal coated particles may also be employed such as metal coated glass flake, glass spheres, glass fibers, boron nitride powder or flake and mica flakes.

The dielectric coating 120 is a high build material that comprises one or more of the following polymers: acrylic emulsion; styrene modified acrylic emulsion; acrylic modified epoxy dispersion; polyurethane dispersion; and dimethylpolysiloxane dispersion. The dielectric coating also contains one or more of the following pigments: magnesium silicate; aluminum silicate; alkali aluminio silicate; calcium carbonate; fumed silica; and ground glass.

The film thickness for the applied conductive coating will vary bases based on the antenna type. For example, the conductive coating backplane or ground plane 110 and the conductive coating patch 130 for a GPS patch type antenna are about 3–20 mils each, while the high build dielectric coating 120 is about 20–150 mils. The dielectric coating 120 in most cases will comprise more than one layer of the high build material in order to achieve the required gap between the conductive coating backplane or ground plane 110 and the conductive coating patch or microstrip array or radiating element 130. The conductive coating backplane or ground plane 110, dielectric coating 120, and the conductive coating patch or microstrip array or radiating element 130 are tailored to specific dimensions necessary for a specific frequency range, in a manner which will be well understood by those of ordinary skill in the art.

The conductive coating backplane or ground plane 110, dielectric coating 120, and conductive coating patch or microstrip array or radiating element 130 can be formed as self-adhesive sheets or films for ease of application and field maintenance of the antenna 100. The antenna 100 can also include a protective film 400 applied over the conductive coating patch or microstrip array or radiating element 130, the dielectric coating 120, and the conductive coating backplane or ground plane 110, for the purpose of reducing environmental degradation and increasing the life expectancy of the other component parts of the antenna 100. The film 400 is made of a material that will not interfere with the ability of the antenna to receive or transmit the desired frequencies.

Where the substrate is a conductive metal, the substrate itself can form the conductive backplane or ground plane, with the dielectric coating 120 being applied to the outer surface of the platform and the conductive coating patch or microstrip array or radiating element 130 being applied to the outer surface of the dielectric coating 120. Where the substrate is a dielectric composite resin, the substrate itself can form the dielectric layer, with the conductive coating backplane or ground plane 110 being applied to the inner surface of the platform and the conductive coating patch or microstrip array or radiating element 130 being applied over the outer surface of the platform.

In accordance with the invention, the method in accordance with the present invention as carried out for a GPS patch type antenna comprises extending a patch lead (for example, the coaxial cable center conductor or connector pin 300) through the substrate structure 200 insulated from the patch lead, applying the conductive coating back plane 110 to the substrate structure 200 insulated from the patch lead, applying the non-conductive dielectric coating 120 over the outer surface 110*b* of the conductive coating back plane 110, and applying the conductive coating patch 130 over the outer surface 120*b* of the dielectric coating 120 electrically connected to the patch lead. It will be appreciated by those of skill in the art that an analogous method can be used for making other microstrip antennas employing a conductive coating backplane or ground plane 110 applied to the outer surface 202 of a substrate structure 200, a non-conductive dielectric coating 120 applied over the outer surface 110*b* of the conductive coating backplane or ground plane 110, and a conductive coating patch or microstrip array or radiating element 130 is applied over the outer surface 120*b* of the dielectric coating 120.

The conductive coating backplane or ground plane 110, the dielectric coating 120, and the conductive coating patch or microstrip array or radiating element 130 can be applied via a variety of methods including but not limited to spraying, for example using conventional spray technology; brushing; roll coating; dip application; and flow coating. The thickness of each of conductive coating backplane or ground plane 110, the dielectric coating 120, and the conductive coating patch or microstrip array or radiating element 130, and thus the number of layers that must be applied, will depend upon the specific antenna design. For some antenna designs, a single layer will be sufficient to achieve the necessary film thickness; whereas for other designs, multiple layers will be necessary to achieve a higher film thickness. The layers are air dried at ambient conditions. Dry to touch times average 20–40 minutes. Dry to service time average 2–6 hours.

A coaxial cable can also be connected directly to the antenna by connecting the coaxial cable shield to the conductive coating backplane 110 with the cable insulator and the center conductor extending through the conductive coating backplane 110 with the center conductor connected to the conductive coating patch 130.

Tests were conducted to compare a prototype GPS patch-type antenna in accordance with the present invention to conventional patch-type micro-strip antennas with a coaxial feed and to a hybrid patch-type antenna constructed for purposes of the test. The micro-strip antenna was chosen due to its commercial availability in its conventional form and its construction, a dielectric middle layer sandwiched between a conductive metal backplane and a conductive metal patch. The design for the conventional antenna was selected with the guidance of The Antenna Engineering Handbook, Richard C. Johnson and Henry Jasik, Editors. The frequency selected was in the range of 1.5 G Hz. This range was chosen due to the fact that the satellite navigation system is in this range. Testing equipment included a Motorola Oncore Evaluation Kit with Wincore controller software and PC controller software; a Synergy Systems M□12 Oncore Receiver, with LNA on adapter board; and a Synergy Systems LLC SA□P2 Passive GPS Antenna. The capacitance measurements were conducted with a Hewlett Packard Model 4262A LCR Meter. The conductivity measurements were conducted with a Fluke Volt Ohm Meter.

The construction of each of the test antennas is summarized in Table I below:

TABLE I

| Test Antenna Number | Conductive Patch | Dielectric | Conductive Backplane | Width (inches) | Length (inches) | Thickness (inches) |
|---|---|---|---|---|---|---|
| 1 | Metal | Air | Metal | 3.24 | 3.66 | 0.2 |
| 2 | Metal | FR4 | Metal | 1.73 | 1.74 | 0.12 |
| 3 | Paint | FR4 | Metal | 1.72 | 1.72 | 0.12 |
| 4 | Paint | FR4 | Paint | 1.72 | 1.79 | 0.12 |

Test Antenna Number 1 was an antenna of conventional design, constructed using a metal backplane, air as a dielectric, and a metal patch, with a coaxial connection. Air was chosen as the dielectric material because of a known dielectric constant.

Test Antenna Number 2 was constructed using a copper clad FR4 circuit board as the backplane. A second copper clad FR4 circuit board was cut to the proper patch size and attached to the first circuit board to form the complete antenna. This construction was chosen to produce comparative data using circuit board material for a dielectric material, with copper as a known conductor. The same coaxial connection as in Test Antenna Number 2 was used.

Test Antenna Number 3 was constructed with copper sheet for a backplane, FR4 circuit board for dielectric material, and the original UNISHIELD® conductive coating composition for the patch. This was the first test antenna where the conductive coating was used. It replaced the metal material for the patch on Test Antennas Numbers 1 and 2. This was the only variable changed, in order to accurately record the data corresponding to each change.

Test Antenna Number 4 was constructed with the original UNISHIELD® conductive coating composition spray-applied to an FR4 circuit board as a backplane. The dielectric depth was constructed with FR4 circuit board. The original UNISHIELD® conductive coating composition also was spray-applied to an FR4 circuit board as the conductive patch. Test Antenna Number 4 eliminated all metal substrates from the antenna design.

The test data for the antennas is set forth in Table II below:

TABLE II

| Test Antenna Number | Frequency | Capacitance (picofarads) | Q | Cable Capacitance | Total Capacitance (farads) |
|---|---|---|---|---|---|
| 1 | 1 kHz | 22.4 | * | 0.0 | $2.24 \times 10^{11}$ |
| | 10 kHz | 22.4 | 1000.0 | 0.0 | $2.24 \times 10^{11}$ |
| 2 | 1 kHz | 36.5 | 166.0 | 0.0 | $3.65 \times 10^{11}$ |
| | 10 kHz | 36.3 | 111.1 | 0.0 | $3.63 \times 10^{11}$ |
| 3 | 1 kHz | 36.8 | 125.0 | 0.0 | $3.68 \times 10^{11}$ |
| | 10 kHz | 36.5 | 100.0 | 0.0 | $3.65 \times 10^{11}$ |
| 4 | 1 kHz | 35.7 | 142.0 | 0.0 | $3.57 \times 10^{11}$ |
| | 10 kHz | 35.4 | 111.1 | 0.0 | $3.54 \times 10^{11}$ |

Figure 6:
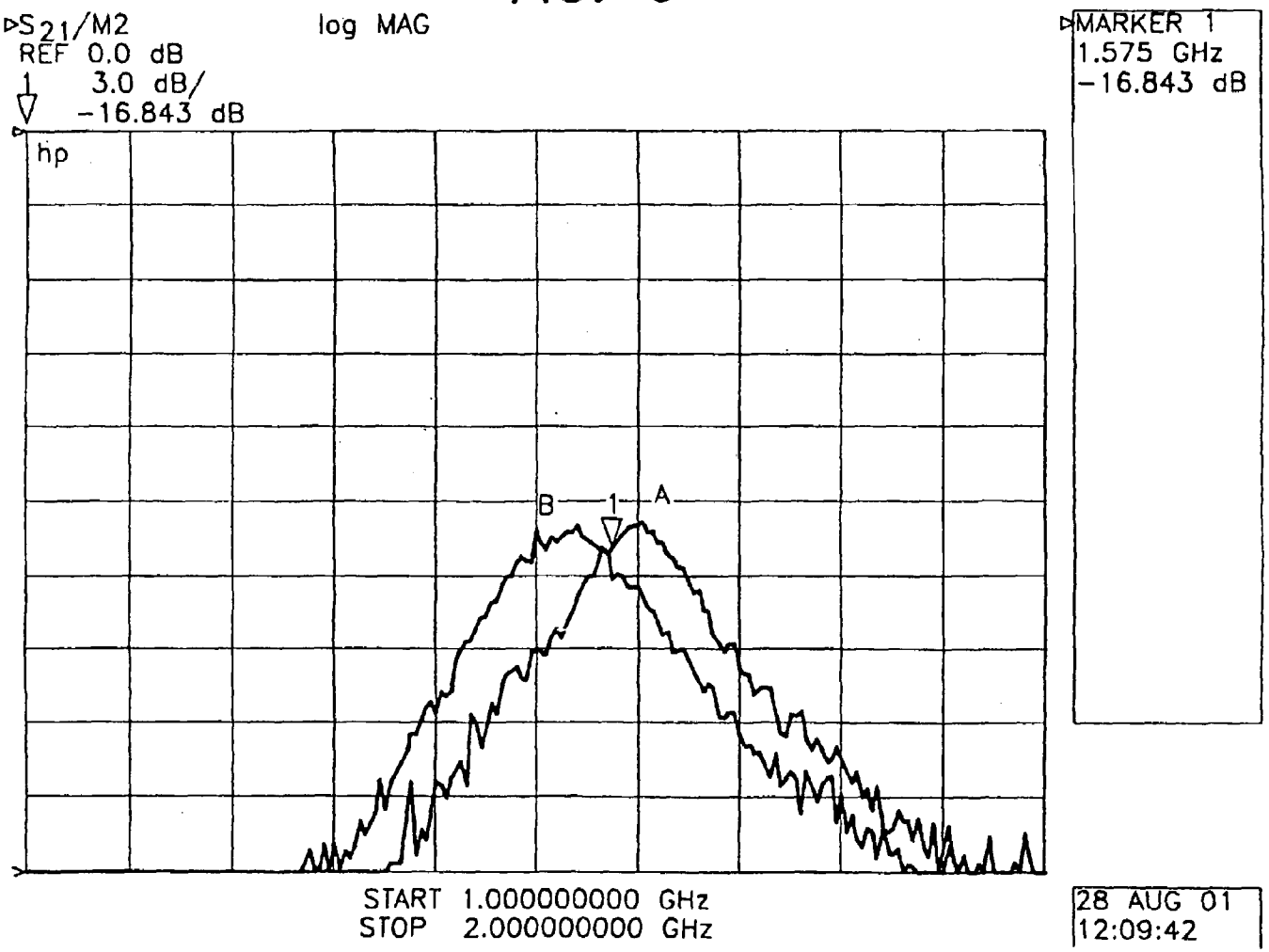
Figure 7:
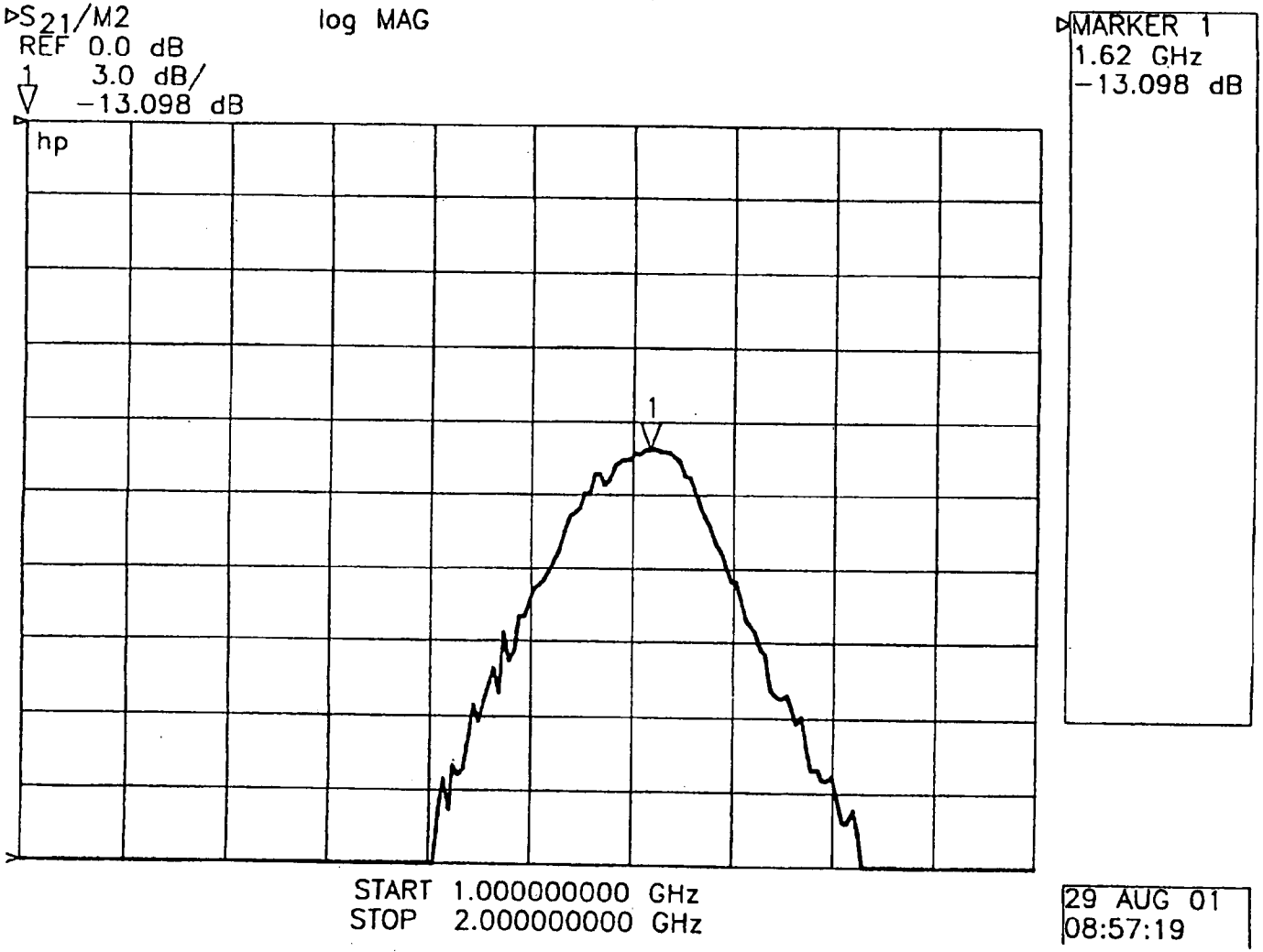
Figure 8:
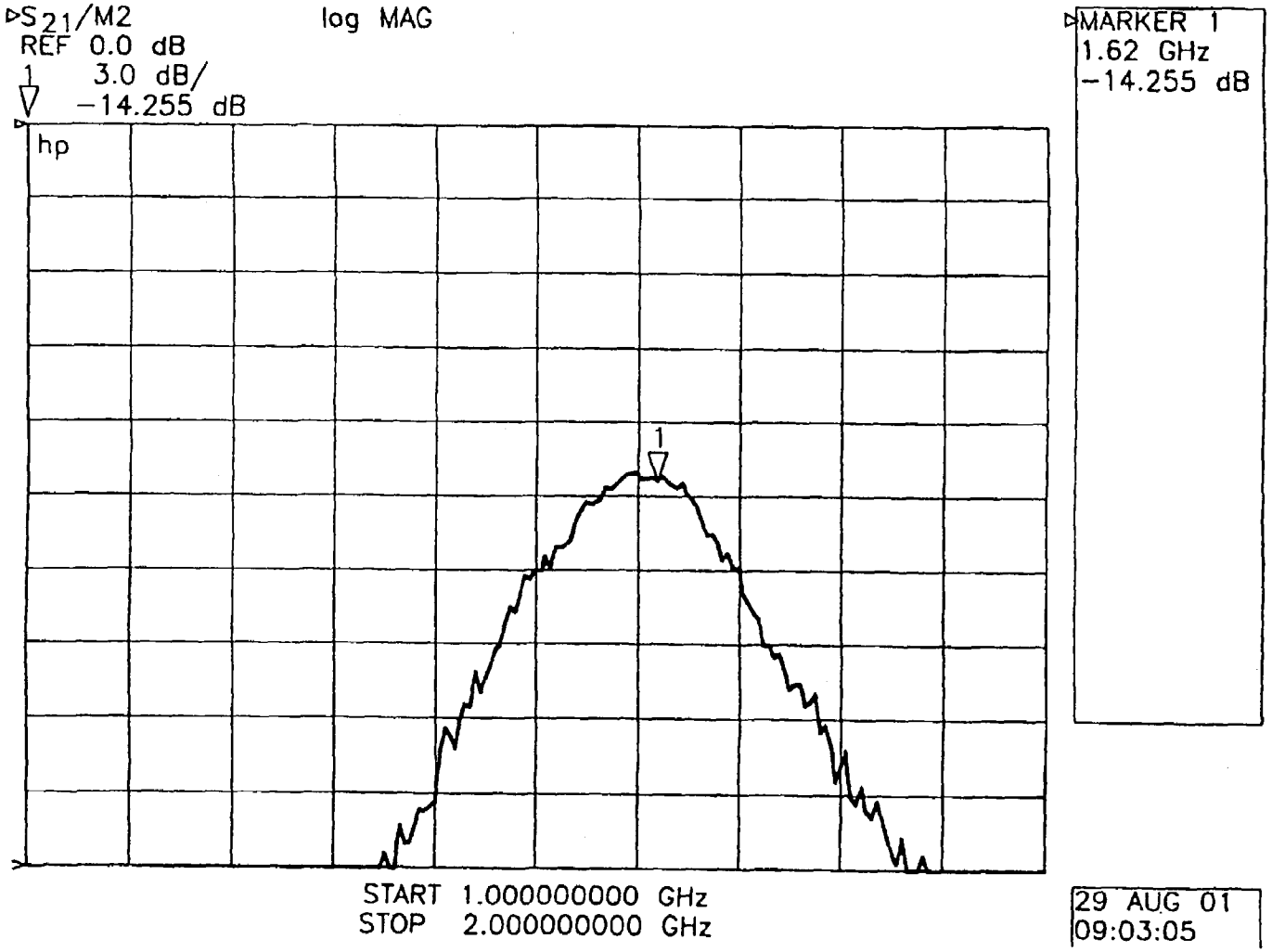
Figure 9:
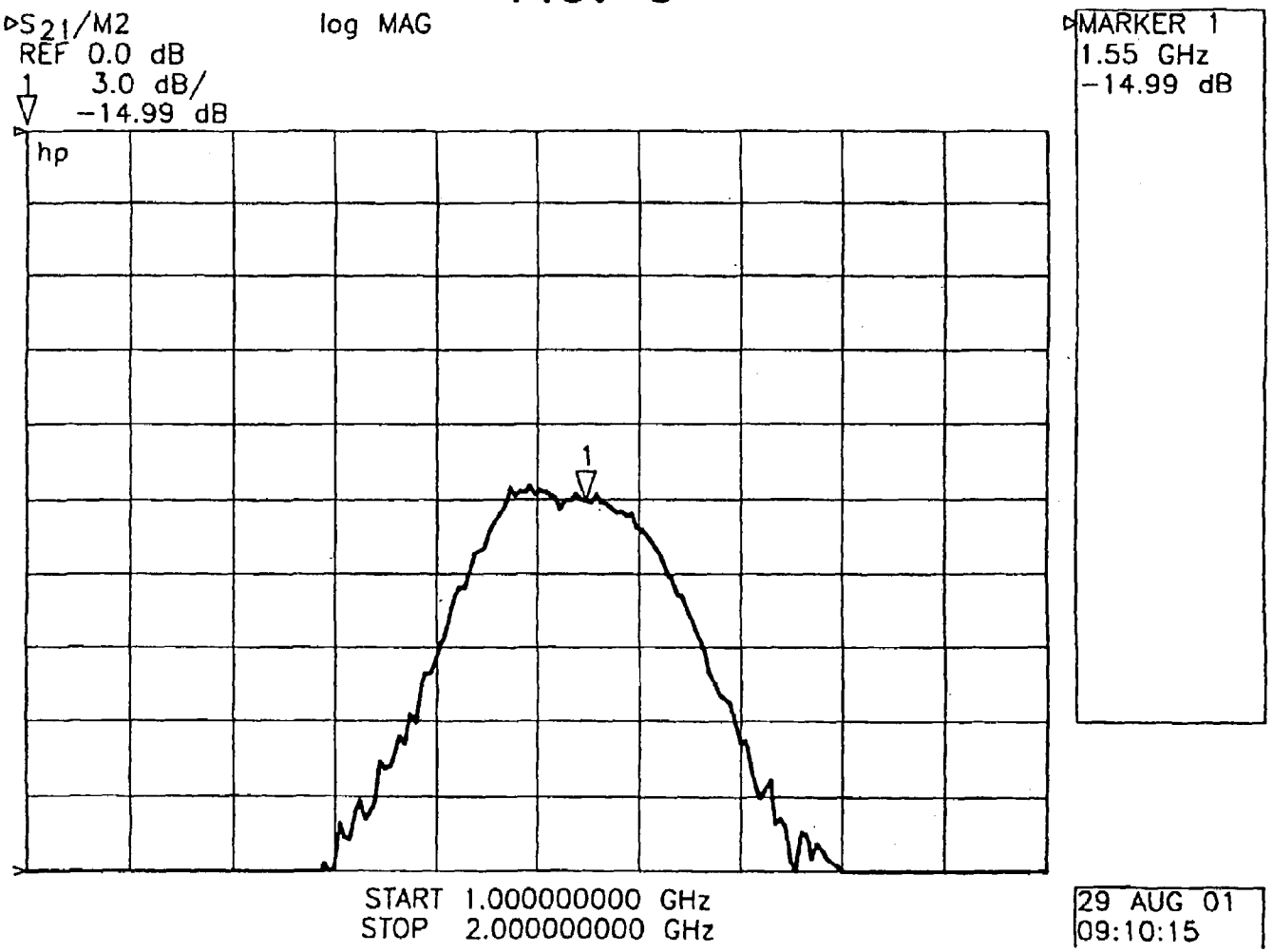
Figure 10:
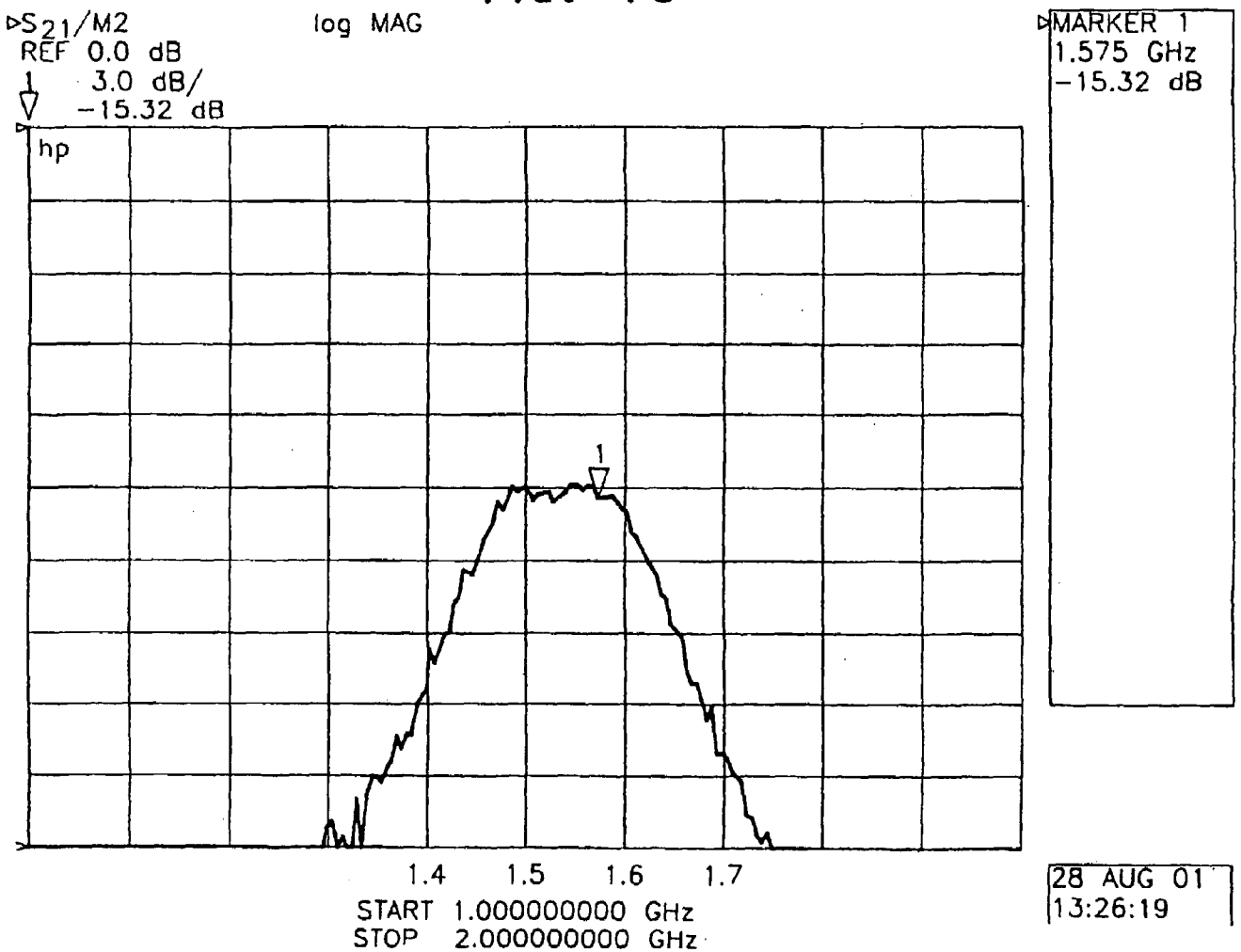

The antenna in accordance with the present invention can be tuned in order to improve its gain. FIGS. 6–12 are graphs demonstrating the improvements in gain achieved by the addition of a tuning stub, frequency (measured in GHz) being plotted against gain (measured in dB). FIG. 6 compares a commercial Motorola antenna (curve A) to untuned Test Antenna Number 4 (curve B), wherein marker 1 denotes the x, y coordinates 1.525 GHz, −14.821 dB. FIG. 7 compares an untuned Test Antenna Number 2 (curve A) to untuned Test Antenna Number 4 (curve B), wherein marker 1 denotes the x, y coordinates 1.575 GHz,_dB. FIG. 8 compares untuned Test Antenna Number 3 (curved A) to untuned Test Antenna Number 4 (curve B), wherein marker 1 denotes the x, y coordinates 1/575 GHz, −16.843 dB. FIG. 9 shows the gain of Test Antenna Number 2 after addition of a tuning stub, wherein marker 1 denotes the x, y coordinates 1.62 GHz, −13.098 dB. FIG. 10 shows the gain of Test Antenna Number 3 after the addition of a tuning stub, wherein marker 1 denotes the x, y coordinates 1.62 GHz, −14.255 dB. FIG. 11 shows the gain of Test Antenna Number 4 after the addition of a tuning stub, wherein marker 1 denotes the x, y coordinates 1.575 GHz, −15.32 dB. FIG. 12 shows the gain of Test Antenna Number 4 after the addition of a tuning stub, wherein marker 1 denotes the x, y coordinates 1.55 GHz, −14.99 dB. From FIGS. 6–12, it can be seen that tuning of Test Antenna Number 4 produced a gain superior to that of the commercial Motorola antenna, as well as to those of Test Antennas Numbers 2 and 3 after tuning.

Test Antennas Numbers 2, 3, and 4 were all successful in receiving satellite signals. From the signals and the amplitude of the signals received during testing, it was demonstrated that the antenna using the original UNISHIELD® conductive coating composition in place of the metal substrates performed as well as antennas of similar design using copper metal for a backplane and patch. The data recorded also demonstrated that the antenna using the original UNISHIELD® conductive coating composition had a capacitance similar to that of the antennas using copper metal.

Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described. Modifications and variations of the above-described embodiments of the present invention are possible, as appreciated by those skilled in the art in light of the above teachings. It is therefore to be understood that, within the scope of the appended claims and their equivalents, the invention may be practiced otherwise than as specifically described.

We claim:

1. An antenna capable of application to both curved and planar platforms, comprising: a conductive backplane; a non-conductive dielectric coating placed on the outer surface of the conductive backplane; and a conductive coating patch applied over the dielectric coating, wherein the conductive coating patch is formed of a dried emulsion.

2. The antenna of claim 1, wherein the conductive coating patch is formed of an electrically conductive and electromagnetic radiation absorptive coating.

3. The antenna of claim 1, wherein the conductive coating patch comprises an emulsion polymer binder containing an acrylic polymer, an effective amount of electrically conductive particles dispersed in the binder, and water as a carrier.

4. The antenna of claim 3, wherein the emulsion polymer binder is a blend of an emulsion containing a conjugated diene monomer or comonomer.

5. The antenna of claim 3, wherein the electrically conductive particles include a combination of graphite particles and metal-containing particles.

6. The antenna of claim 5, wherein the graphite particles comprise natural flake graphite and the metal-containing particles comprise silver or nickel containing particles.

7. The antenna of claim 1, wherein the conductive backplane is formed of a dried emulsion.

8. The antenna of claim 1, wherein the conductive backplane is formed of an electrically conductive and electromagnetic radiation absorptive coating.

9. The antenna of claim 1, wherein the conductive backplane comprises a coating applied to an outer surface of a substrate.

10. The antenna of claim 7, wherein the conductive coating backplane comprises an emulsion polymer binder containing an acrylic polymer, an effective amount of electrically conductive particles dispersed in the binder, and water as a carrier.

11. The antenna of claim 10, wherein the emulsion polymer binder is a blend of an emulsion containing a conjugated diene monomer or comonomer.

12. The antenna of claim 10, wherein the electrically conductive particles include a combination of graphite particles and metal-containing particles.

13. The antenna of claim 12, wherein the graphite particles comprise natural flake graphite and the metal-containing particles comprise silver or nickel containing particles.

14. The antenna of claim 1, wherein the non-conductive dielectric comprises a coating.

15. The antenna of claim 14, wherein the non-conductive dielectric is formed of a dried emulsion.

16. The antenna of claim 14, wherein the dielectric coating comprises a high build material comprising at least one polymer selected from the group consisting of acrylic emulsion, styrene modified acrylic emulsion, acrylic modified epoxy dispersion, polyurethane dispersion, and dimethylpolysiloxane dispersion.

17. The antenna of claim 16, wherein the dielectric coating further comprises at least one pigment selected from the group consisting of magnesium silicate, aluminum silicate, alkali aluminio silicate, calcium carbonate, fumed silica, and ground glass.

18. The antenna of claim 9, wherein the non-conductive dielectric comprises a coating.

19. The antenna of claim 1, wherein the conductive backplane comprises a conductive metal substrate and wherein the non-conductive dielectric comprises a coating.

20. The antenna of claim 1, wherein the dielectric comprises a composite resin and wherein the conductive backplane comprises a coating.

21. An antenna for application to a substrate having a curved outer surface, comprising: a conductive coating backplane applied to the outer surface of the substrate, the conductive coating backplane having an inner surface facing towards the outer surface of the substrate and an outer surface facing away from the outer surface of the substrate; a non-conductive dielectric coating applied over the outer surface of the conductive coating backplane, the dielectric coating having an inner surface facing towards the outer surface of the conductive coating backplane and an outer surface facing away from the outer surface of the conductive coating backplane; and a conductive coating patch applied over the outer surface of the dielectric coating, the conductive coating patch having an inner surface facing towards the outer surface of the dielectric coating and an outer surface facing away from the outer surface of the dielectric coating, wherein the conductive coating patch is formed of a dried emulsion.

22. The antenna of claim 21, wherein the conductive coating patch is formed of an electrically conductive and electromagnetic radiation absorptive coating.

23. The antenna of claim 21, wherein the conductive coating backplane is formed of a dried emulsion.

24. The antenna of claim 21, wherein the conductive coating backplane is formed of an electrically conductive and electromagnetic radiation absorptive coating.

25. A method of forming an antenna on a substrate having a curved surface, comprising the steps of: applying a conductive coating backplane to the curved surface of the substrate; applying a non-conductive dielectric coating over the conductive coating backplane; and applying a conductive coating patch over the dielectric coating, wherein the conductive coating patch is formed of a dried emulsion.

26. The method of claim 25, wherein all of said applying steps comprise spraying.

27. The antenna of claim 25, wherein in said step of applying a conductive coating patch, the conductive coating patch is formed of an electrically conductive and electromagnetic radiation absorptive coating.

28. The antenna of claim 25, wherein in said step of applying a conductive coating backplane, the conductive coating backplane is formed of a dried emulsion.

29. The antenna of claim 25, wherein in said step of applying a conductive coating backplane, the conductive coating backplane is formed of an electrically conductive and electromagnetic radiation absorptive coating.

* * * * *